US009750387B2

(12) United States Patent
Taylor et al.

(10) Patent No.: US 9,750,387 B2
(45) Date of Patent: Sep. 5, 2017

(54) SELECTABLY ATTACHABLE BUFFING PAD

(71) Applicants: Darby Taylor, Afton, OK (US); Monte Langley, Afton, OK (US)

(72) Inventors: Darby Taylor, Afton, OK (US); Monte Langley, Afton, OK (US)

( * ) Notice: Subject to any disclaimer, the term of this patent is extended or adjusted under 35 U.S.C. 154(b) by 0 days.

(21) Appl. No.: 14/940,032

(22) Filed: Nov. 12, 2015

(65) Prior Publication Data

US 2017/0135545 A1 May 18, 2017

(51) Int. Cl.
*A47L 13/28* (2006.01)

(52) U.S. Cl.
CPC ..... *A47L 13/28* (2013.01)

(58) Field of Classification Search
CPC ..... A47L 13/28; A47L 11/00; A47L 11/02; A47L 11/16; A47L 11/162; B24D 13/14; B24D 13/20; B24B 29/00
See application file for complete search history.

(56) References Cited

U.S. PATENT DOCUMENTS 3,007,189 A * 11/1961 Crane ..... B24D 13/145 15/230
3,346,904 A 10/1967 Armstrong
4,617,767 A 10/1986 Ali
4,692,958 A * 9/1987 McMakin ..... B24D 13/145 15/230
5,138,735 A 8/1992 Kusz et al.
5,292,567 A 3/1994 Foster
5,299,366 A 4/1994 Maier et al.
5,332,760 A * 7/1994 Weisman ..... C08J 9/32 521/137
6,451,750 B2 9/2002 Hewitt et al.
6,986,706 B1 1/2006 Cooper et al.

* cited by examiner

*Primary Examiner* — Shay Karls
(74) *Attorney, Agent, or Firm* — Law Office of Jerry D Haynes

(57) ABSTRACT

A selectively attachable buffer pad for using as an attachment to a conventional drill to buff or polish surfaces includes an attachment member which defines an elongated, rigid shank which is sized and shaped to be secured in the chuck of a conventional drill, a padded layer defining a planar body with a circular shape which is constructed out of a deformable material, and a buffer layer defining a conventional soft fiber buffing pad. Advantageously, the deformable nature of the padded layer enables selectively attachable buffer pad to transfer rotation from the attachment member to the buffer layer while also providing shock absorption. Thus, a conventional drill which is not otherwise suit for buffing or polishing is configured to accomplish the same through its attachment to the selectively attachable buffer pad.

4 Claims, 1 Drawing Sheet

SELECTABLY ATTACHABLE BUFFING PAD

BACKGROUND OF THE INVENTION

Field of the Invention

This invention relates generally to tool accessories and, more particularly, to a buffing pad that is selectively attachable to a sanding pad on a conventional sanding device.

Description of the Prior Art

The use and design of conventional electrical buffers/polishers is well known. Such conventional buffers/polishers typically define dedicated electrical devices have one or a plurality of buffer/polishing attachments which can be used. There remains a need, however, for a selectively attachable buffer pad which could be used with a conventional cordless drill, eliminating the need for a dedicated buffer. It would be helpful if such a selectively attachable buffer pad utilized a plural layer body which enabled the transfer of rotation to the buffing material while also cushioning the rigidity of the drill connection. It would be additionally desirable for the layers of such a selectively attachable buffer pad to be permanently fixed together so as to ensure the buffing material and cushion material remained in position to prevent inadvertent scratching of a surface.

The Applicant's invention described herein provides for a selectively attachable buffer pad adapted to allow a user to employ a conventional electrical drill, including a cordless drill, to buffer or polish a surface. The primary components in Applicant's selectively attachable buffer pad are an attachment member, a padded layer, and a buffer layer. When in operation, the selectively attachable buffer pad enables safe, effective buffing of surfaces in the absence of a dedicated buffer/polisher. As a result, many of the limitations imposed by prior art structures are removed.

SUMMARY OF THE INVENTION

A selectively attachable buffer pad for using as an attachment to a conventional drill to buff or polish surfaces. The selectively attachable buffer pad includes an attachment member which defines an elongated, rigid shank which is sized and shaped to be secured in the chuck of a conventional drill, a padded layer defining a planar body with a circular shape which is constructed out of a deformable material, and a buffer layer defining a conventional soft fiber buffing pad. Advantageously, the deformable nature of the padded layer enables selectively attachable buffer pad to transfer rotation from the attachment member to the buffer layer while also providing shock absorption. Thus, a conventional drill which is not otherwise suit for buffing or polishing is configured to accomplish the same through its attachment to the selectively attachable buffer pad.

It is an object of this invention to provide a selectively attachable buffer pad which could be used with a conventional cordless drill, eliminating the need for a dedicated buffer.

It is another object of this invention to provide a selectively attachable buffer pad which utilizes a plural layer body which enabled the transfer of rotation to the buffing material while also cushioning the rigidity of the drill connection.

It is yet another object of this invention to provide a selectively attachable buffer pad having layers that are permanently fixed together so as to ensure the buffing material and cushion material remained in position to prevent inadvertent scratching of a surface.

These and other objects will be apparent to one of skill in the art.

DETAILED DESCRIPTION OF THE INVENTION

Figure 1:
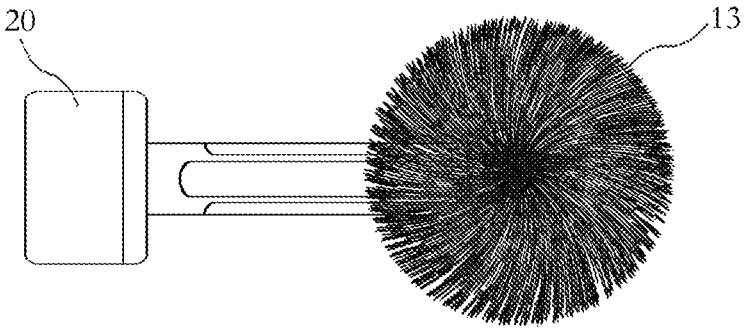
FIG. 1 is a bottom plan view of a selectively attachable buffer pad built in accordance with the present invention attached to a handheld, cordless drill.
Figure 2:
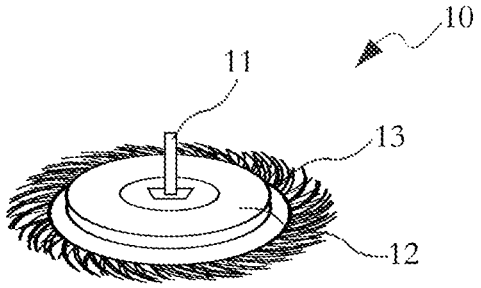
FIG. 2 is a side perspective view of a selectively attachable buffer pad built in accordance with the present invention.

Referring now to the drawings and in particular FIGS. 1 and 2, a selectively attachable buffer pad 10 is shown having an attachment member 11, a padded layer 12, and a buffer layer 13. The attachment member 11 defines an elongated, rigid shank which is sized and shaped to be secured in the chuck of a conventional drill 20 at a distal end and is permanently fixed to the padded layer 12 at a proximal end. In this regard, the attachment member 11 enables the selectively attachable buffer pad 10 to be rotatably fixed to a conventional drill.

The padded layer 12 is a planar body with a circular shape which is constructed out of a deformable material. In one embodiment, the padded layer 12 is constructed out of a soft foam, such as a foam having a 12 indentation load deflection (ILD). In other embodiments, the padded layer 12 is constructed out of a hard foam, such as a foam having a 70 ILD. It is contemplated that the use of a padded layer 12 having a lower ILD (being relatively soft foam) configures the selectively attachable buffer pad 10 for use on surfaces that are relatively uneven, while the use of a padded layer 12 having a higher ILD (being relatively soft foam) configures the selectively attachable buffer pad 10 to work faster on surfaces that are substantially smooth.

In any embodiment, it is contemplated that because the padded layer 12 is able to yield to weight and pressure, it enables selectively attachable buffer pad 10 to transfer rotation from the attachment member 11 to the buffer layer 13 while absorbing shock, whether from a user's handling of the drill 20 or the contours of a surface being contacted by the buffer layer 13.

The buffer layer 13 defines a conventional buffing pad. In some embodiments, the buffer layer 13 defines a twisted wool buffing pad or a microfiber buffing pad and has a 6 inch diameter. In such embodiments, the side of the buffer layer 13 opposite the twisted wool/microfiber is permanently fixed to the padded layer 12. Advantageously, because the buffer layer's 13 6 inch diameter is smaller than many conventional electrical buffers/polishers, it is able to reach into areas that would not be accessible to such conventional machines.

It is appreciated that while the selectively attachable buffer pad 10 may be used with any conventional drill that includes a chuck for attaching shanks, when used with cordless drills, such as an 18 volt cordless angle drill, the selectively attachable buffer pad 10 provides added portability relative to many conventional electrical buffers/polishers which require an electrical outlet.

It is contemplated that the attachment device 11 may be molded into the padded layer 12, and the buffer layer 13 may be adhered to the padded layer 12.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A selectively attachable buffer pad, comprising:

an attachment member defining an elongated, rigid shank having a first end and a second end, wherein the first end is sized and shaped to be secured in the chuck of a conventional drill;

a padded layer constructed out of a deformable material, wherein said deformable material has a specific indentation load deflection adapted to yield to weight and pressure and having an attachment side and an under side, wherein said second end is integrated with said attachment side, wherein the specific indentation load deflection is 12; and a buffer layer defining a soft fiber buffing pad having a top side, wherein said top side is integrated with said under side, wherein the padded layer enables the buffer layer to transfer rotation from the attachment member to the buffer layer while absorbing shock.

2. The selectively attachable buffer pad of claim 1, wherein said second end is molded into said attachment side.

3. The selectively attachable buffer pad of claim 1, wherein said top side and said under side are permanently secured together through an adhesive.

4. The selectively attachable buffer pad of claim 1, wherein the padded layer defines a planar body with a circular shape and said buffer layer is circular, thereby ensuring weight is evenly distributed when the rotated.

* * * * *